US010672575B2

(12) United States Patent
Rhein et al.

(10) Patent No.: US 10,672,575 B2
(45) Date of Patent: Jun. 2, 2020

(54) CURRENT INTERRUPTER FOR HIGH VOLTAGE SWITCHES

(71) Applicant: Hubbell Incorporated, Shelton, CT (US)

(72) Inventors: David A. Rhein, St. Jacob, IL (US); Daniel Breyre, New York, NY (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/670,485

(22) Filed: Aug. 7, 2017

(65) Prior Publication Data

US 2017/0338068 A1 Nov. 23, 2017

Related U.S. Application Data

(63) Continuation of application No. 14/175,465, filed on Feb. 7, 2014, now Pat. No. 9,761,394.

(60) Provisional application No. 61/762,579, filed on Feb. 8, 2013.

(51) Int. Cl.
*H01H 33/666* (2006.01)

(52) U.S. Cl.
CPC ... *H01H 33/666* (2013.01); *H01H 2033/6665* (2013.01); *H01H 2033/6667* (2013.01)

(58) Field of Classification Search
CPC ..... H01H 33/666; H01H 33/66238; H01H 33/662; H01H 2033/66223; H01H 33/66; H01H 2033/66253; H01H 2033/6665
USPC ..... 218/140, 139, 134, 135, 153–155, 5, 7, 218/151, 118, 138
See application file for complete search history.

(56) References Cited

U.S. PATENT DOCUMENTS

| | | | | |
|---|---|---|---|---|
| 2,979,587 A * | 4/1961 | Jennings | ..... | H01H 33/66 218/135 |
| 3,522,404 A | 8/1970 | Trayer | | |
| 3,813,506 A | 5/1974 | Mitchell | | |
| 3,814,885 A | 6/1974 | Sofianek | | |
| 3,839,612 A * | 10/1974 | Badey | ..... | H01H 33/14 218/4 |
| 4,070,558 A | 1/1978 | Stewart | | |
| 4,086,461 A | 4/1978 | Gonek | | |
| 4,115,672 A | 9/1978 | Lipperts | | |
| 4,124,790 A | 11/1978 | Kumbera et al. | | |
| 4,323,871 A | 4/1982 | Kamp et al. | | |
| 4,381,435 A | 4/1983 | Barkan | | |
| 4,492,835 A | 1/1985 | Turner | | |

(Continued)

*Primary Examiner* — William A Bolton
(74) *Attorney, Agent, or Firm* — Michael Best & Friedrich, LLP

(57) ABSTRACT

The present invention provides a vacuum interrupter for interrupting a voltage. The vacuum interrupter includes a vacuum bottle housing having an interior and an exterior, and at least one vacuum bottle positioned within the interior of the vacuum bottle housing. The at least one vacuum bottle includes axially separable contacts within it, including at least one moveable contact. The vacuum interrupter further includes an operating mechanism including a clevis configured to reciprocate the moveable contact. The vacuum interrupter further includes a seal between the vacuum bottle housing and the operating mechanism sealing the operating mechanism from the interior of the vacuum bottle, wherein the seal includes a first end and a second end, the first end coupled to the clevis and the second end coupled to the vacuum bottle housing.

20 Claims, 12 Drawing Sheets

(56) References Cited

U.S. PATENT DOCUMENTS 4,503,411 A 3/1985 Lofstrand
4,506,121 A 3/1985 Peterson et al.
4,527,028 A 7/1985 Luehring
4,562,506 A 12/1985 Moran
4,568,804 A 2/1986 Luehring
4,618,749 A 10/1986 Bohme
4,625,189 A 11/1986 Lazar et al.
4,680,706 A 7/1987 Bray
4,797,777 A 1/1989 Beard
4,798,921 A 1/1989 Watanabe
4,839,481 A 6/1989 Nash et al.
4,879,441 A 11/1989 Hamm et al.
4,935,712 A 6/1990 Oyama et al.
4,935,715 A 6/1990 Popeck
5,055,640 A 10/1991 Lippi et al.
5,099,382 A 3/1992 Eppinger
5,103,364 A 4/1992 Kamp et al.
5,117,325 A 5/1992 Dunk et al.
5,124,678 A 6/1992 Yamat et al.
5,175,403 A 12/1992 Hamm et al.
5,191,180 A * 3/1993 Kitamura ..... H01H 33/666 218/135
5,206,616 A 4/1993 Stegmuller
5,387,772 A 2/1995 Bestel
5,388,451 A 2/1995 Stendin
5,422,450 A 6/1995 Miyazawa
5,452,172 A 9/1995 Lane et al.
5,497,096 A 3/1996 Banting
5,521,348 A 5/1996 Berndt et al.
5,589,675 A 12/1996 Walters et al.
5,597,992 A 1/1997 Walker
5,663,712 A 9/1997 Kamp et al.
5,729,888 A 3/1998 Abdelgawad et al.
5,747,766 A 5/1998 Waino et al.
5,808,258 A 9/1998 Luzzi
5,864,108 A 1/1999 Rohling et al.
5,912,604 A 6/1999 Harvey et al.
5,917,167 A 6/1999 Bestel
5,952,635 A * 9/1999 Plat ..... H01H 33/6661 218/43
6,020,567 A 2/2000 Ishikawa et al.
6,144,005 A 11/2000 Tanimizu et al.
6,198,062 B1 3/2001 Mather et al.
6,242,708 B1 6/2001 Marchand et al.
6,373,015 B1 4/2002 Marchand et al.
6,696,658 B2 2/2004 Kowalyshen et al.
6,753,493 B2 6/2004 Rhein et al.
6,888,086 B2 5/2005 Daharsh et al.
9,761,394 B2 * 9/2017 Rhein ..... H01H 33/666
2006/0266630 A1 11/2006 Stepniak
2009/0084762 A1 4/2009 Wristen et al.
2010/0000972 A1 * 1/2010 Bodenstein ..... H01H 1/50 218/140
2012/0000972 A1 * 1/2012 Learn ..... B65D 5/667 229/112
2012/0193325 A1 8/2012 Borgstrom
2015/0170856 A1 6/2015 Rhein

* cited by examiner

CURRENT INTERRUPTER FOR HIGH VOLTAGE SWITCHES

CROSS REFERENCE TO RELATED APPLICATIONS

This application claims benefit to U.S. Non-Provisional application Ser. No. 14/175,465 filed on Feb. 7, 2014, which claims benefit to U.S. Provisional Application No. 61/762,579 filed on Feb. 8, 2013, the disclosures of which is incorporated herein by reference for all purposes.

FIELD OF THE INVENTION

This invention relates to an improved current interrupter, and particularly, an improved current interrupter for integration with a high voltage air switch including a compartmentalized housing design for isolating an operating mechanism from one or more vacuum bottle interrupters.

BACKGROUND

Conventional current interrupters comprise one or more serially connected vacuum bottles. Each vacuum bottle houses a pair of contacts that are separated or contacted in order to open or close the circuit. These contacts in the vacuum bottles are opened and closed by a bi-stable mechanism located at one end of the current interrupter.

For conventional current interrupters, the vacuum bottles and bi-stable mechanism are contained within a single housing filled with a pressurized gas. The gas isolates the vacuum bottles from the environment, for example, to protect from moisture, which is a recognized problem for vacuum bottles. However, as the bi-stable mechanism is operated with a rotary shaft that extends through the housing, it can be difficult to effectively seal this portion of the housing.

Accordingly, a need exists for a vacuum interrupter with an improved housing for isolating the vacuum bottles from the environment.

SUMMARY

The present invention provides a vacuum interrupter including a compartmentalized housing design for isolating an operating mechanism from one or more vacuum bottle interrupters. The vacuum interrupter includes a vacuum bottle housing having an interior and an exterior, and at least one vacuum bottle positioned within the interior of the vacuum bottle housing. The at least one vacuum bottle includes axially separable contacts within it, including at least one moveable contact. The vacuum interrupter further includes an operating mechanism including a clevis, the clevis to reciprocate the moveable contact. The vacuum interrupter further includes a seal between the vacuum bottle housing and the operating mechanism sealing the operating mechanism from the interior of the vacuum bottle, wherein the seal includes a first end and a second end, the first end coupled to the clevis and the second end coupled to the vacuum bottle housing.

In one aspect, the seal is a bellows and in another aspect, the at least one vacuum bottle is serially connected and positioned within the interior of the vacuum bottle housing. The moveable contact of each of the vacuum bottles is coupled to a spring-biased pedestal plate, and the spring biased pedestal plates are connected with a rigid member. In one aspect, the rigid member comprises a dielectric material.

In another aspect, the vacuum bottle housing is pressurized. The housing can be a solid housing such as a polymer epoxy, and more particularly, a cycloaliphatic polymer epoxy.

According to another embodiment of the present disclosure, a vacuum interrupter for interrupting a voltage includes a vacuum bottle housing having an exterior and an interior. The vacuum bottle housing generally defines an elongated fiberglass tube. At least one vacuum bottle is positioned within the interior of the vacuum bottle housing. The at least one vacuum bottle includes axially separable contacts within it including a fixed contact and a moveable contact. An operating mechanism is coupled to the moveable contact. The operating mechanism includes a clevis configured to reciprocate the movable contact. A seal is disposed between the vacuum bottle housing and the operating mechanism sealing the operating mechanism from the interior of the vacuum bottle, the seal including a first end and a second end, the first end coupled to the clevis and the second end coupled to the vacuum bottle housing.

In one aspect, the at least one vacuum bottle is serially connected and positioned within the interior of the vacuum bottle housing. In another aspect, the moveable contact of each of the vacuum bottles is coupled to a spring-biased pedestal plate. In yet another aspect, the spring biased pedestal plates are connected with a rigid member. In one aspect, the rigid member comprises a dielectric material. In another aspect, the vacuum bottle housing is pressurized. The housing can be a solid housing such as a polymer epoxy, and more particularly, a cycloaliphatic polymer epoxy.

According to yet another embodiment of the present disclosure, a vacuum interrupter for interrupting a voltage can include a vacuum bottle housing having a pressurized interior and an exterior. At least one vacuum bottle is positioned within the interior of the vacuum bottle housing. The at least one vacuum bottle includes axially separable contacts within it, at least one of which is a moveable contact. An operating mechanism includes a clevis configured to reciprocate the moveable contact. A seal is disposed between the vacuum bottle housing and the operating mechanism sealing the operating mechanism from the interior of the vacuum bottle, the seal including a first end and a second end, the first end coupled to the clevis and the second end coupled to the vacuum bottle housing.

A general objective of the present invention is to provide a vacuum interrupter having an improved overall construction. This objective is accomplished by providing a design for a vacuum interrupter comprised of separate housing for the vacuum bottle, sealed from the operating mechanism.

The foregoing and other objects and advantages of the invention will appear from the following description. In the description, reference is made to the accompanying drawings which form a part hereof, and in which there is shown by way of illustration a preferred embodiment of the invention.

BRIEF DESCRIPTION OF THE DRAWINGS

Like reference numerals will be used to refer to like parts from figure to figure in the following detailed description.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

As also discussed above, in various situations it may be useful to provide a vacuum interrupter including vacuum bottles and an operating mechanism in a pressurized housing. The operating mechanism is actuated from an exterior of the housing to open and close axially separable contacts within the vacuum bottles on the interior. For example, a control arm can be pivoted to rotate a toggle within the housing that can displace a bi-stable assembly for opening and closing the vacuum bottle contact. The housing can be sealed and pressurized to protect the interior of the vacuum interrupter from moisture and contamination in general. However, it can be difficult to provide a seal between the operating mechanism on the interior of the housing and the actuator on the exterior. Various other problems may also arise depending on the operating mechanism used.

Use of the disclosed vacuum interrupter may address these and other issues. For example, the present disclosure provides a current interrupter including a compartmentalized housing design for sealing one or more vacuum bottles within a housing separated from an operating mechanism. The vacuum bottles can be sealed and in communication with the operating mechanism through the seal. In general, the disclosed vacuum interrupter can be used to improve the overall operation of voltage interrupting equipment with respect to providing a sealed, pressurized environment.

Figure 1:
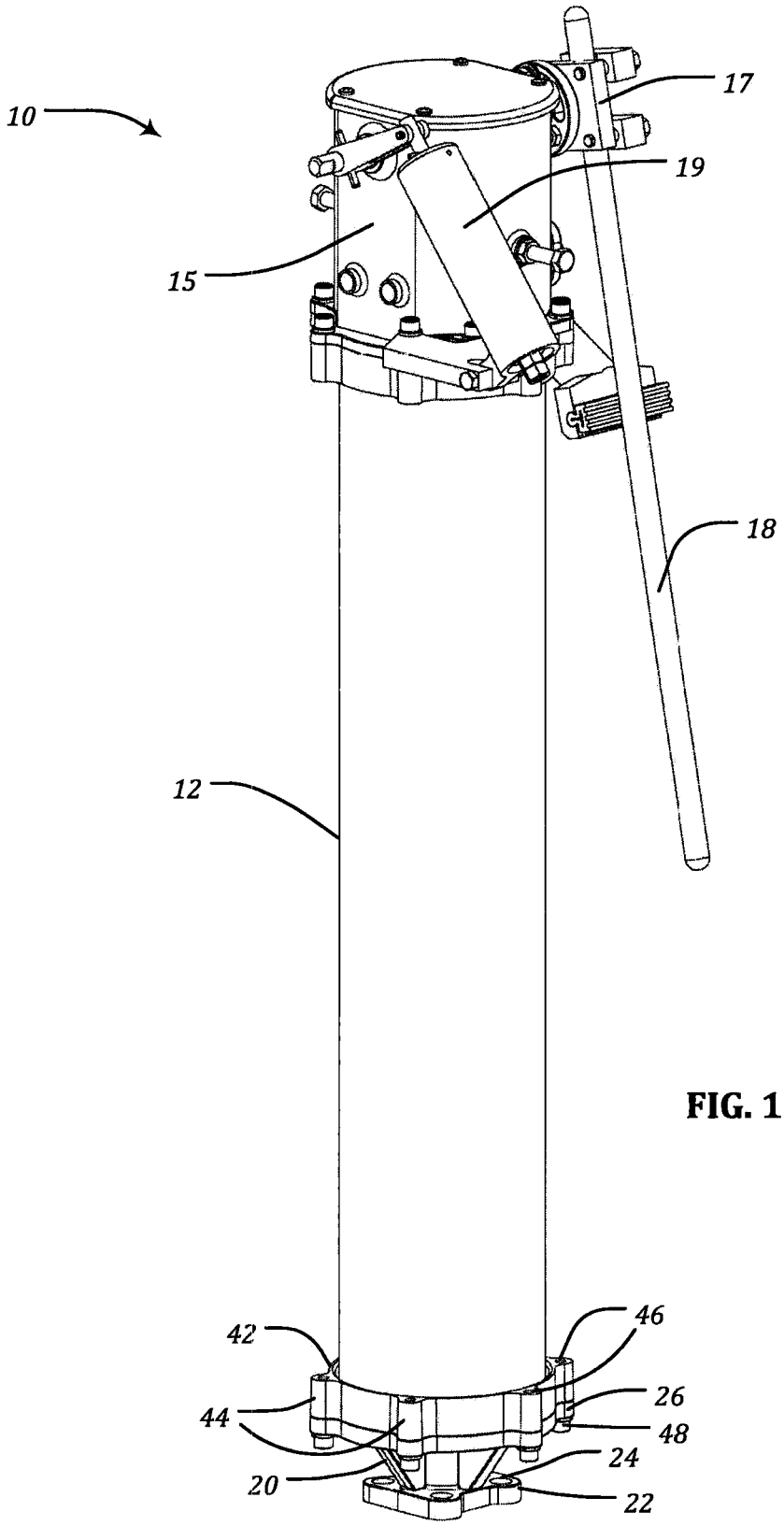
FIG. 1 is perspective view of an embodiment of a current interrupter according to the present disclosure.

Referring to FIG. 1, a perspective view of a non-limiting example of a vacuum interrupter 10 for interrupting a voltage is shown. The current interrupter 10 has a generally elongate, cylindrical construction comprising a centrally positioned vacuum bottle housing 12. The vacuum bottle housing 12 can be a sealed vessel formed from an insulating material such as a fiberglass tube. An interior 14 of the vacuum bottle housing 12 can accommodate one or more vacuum bottles 50 (see, for example, FIG. 2) that are operable to interrupt a voltage. One end of the vacuum bottle housing 12 can be coupled to an operating mechanism housing 15 that contains a bi-stable operating mechanism 16 for operating the one or more vacuum bottles 50 within the vacuum bottle housing 12. The bi-stable operating mechanism 16 can be manipulated with an actuator 17 that can include a rotatably mounted control arm 18. A spring operated reset mechanism 19 can be in communication with the actuator 17 to bias the vacuum interrupter 10, and in particular, the one or more vacuum bottles 50 towards a closed or uninterrupted position.

Whereas a first end of the vacuum bottle housing 12 can be coupled to the operating mechanism housing 15, a second, opposing end can be coupled to a foot 21 for mounting the vacuum interrupter 10. The lower end 22 of the foot 20 can be secured by bolts passing through holes 24 in order to mount the vacuum interrupter 10 to a structure such as an air break switch structure insulator (not shown) or another component of a power transmission structure.

Figure 2:
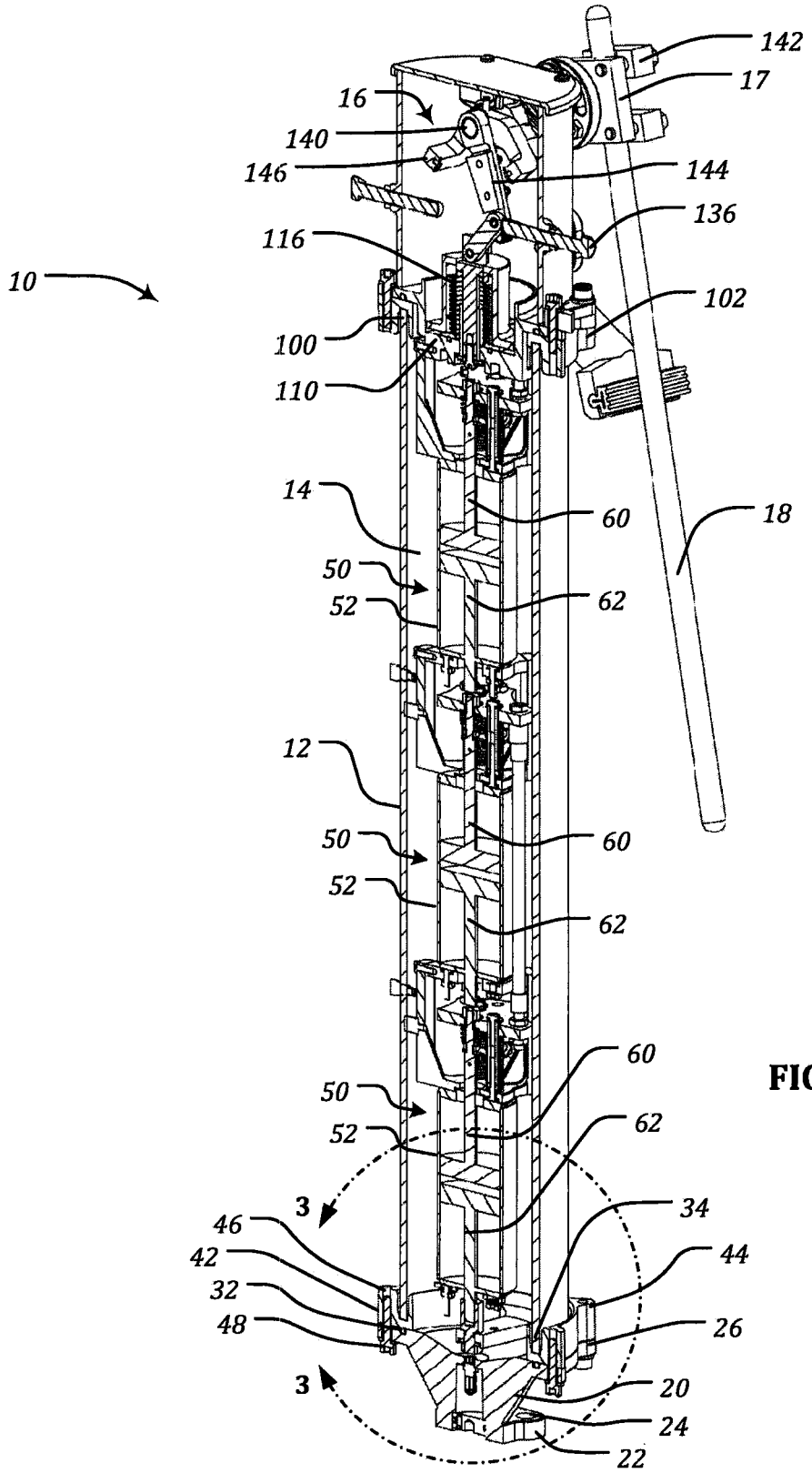
FIG. 2 is a cross-sectional perspective view showing the current interrupter of FIG. 1.

The interior 14 of the vacuum bottle housing 12 as illustrated in FIG. 2 can include three vacuum bottles 50, which can be connected in series. While three vacuum bottles 50 are shown in the illustrated embodiment, a vacuum interrupter 10 can include one or more vacuum bottles 50, such as between one and eight vacuum bottles. In one example, a current interrupter 10 can include a single vacuum bottle 50 to accommodate a 27 kV system, whereas in another example, eight vacuum bottles 50 may be serially connected within a single vacuum bottle housing 12 to accommodate a 230 kV system.

Each of the vacuum bottles 50 can have an outer shell 52 surrounding axially separable contacts including a fixed contact 60 and a moveable contact 62. The moveable contacts 60 can be coupled for concurrent operation with bi-stable operating mechanism 16. In the illustrated embodiment, a moveable contact 60 of the uppermost vacuum bottle 50 (i.e., the vacuum bottle 50 closest to the operating mechanism housing 15) is coupled to the bi-stable operating mechanism 16. Aspects of the bi-stable operating mechanism 16 and vacuum bottles 50 are described in greater detail herein.

Figure 3:
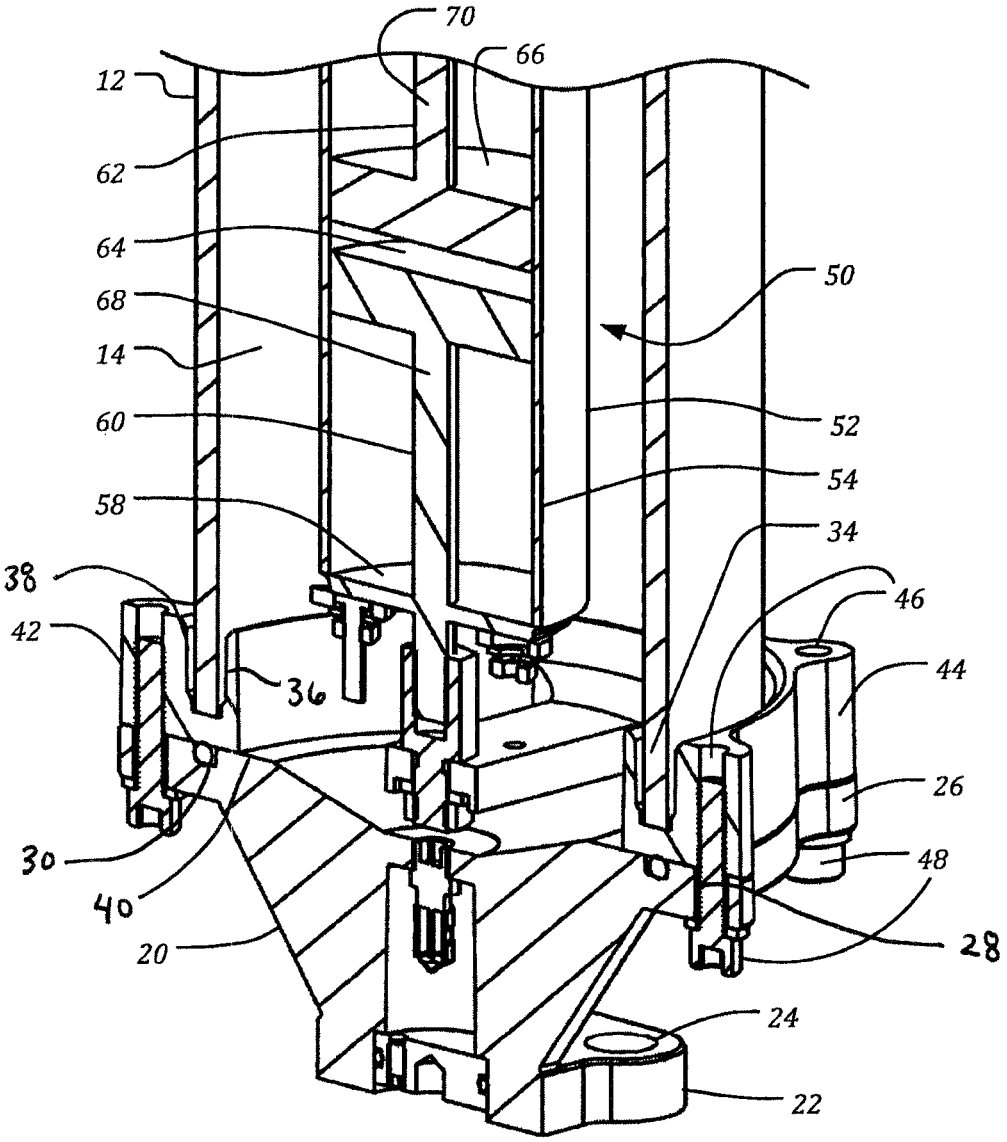
FIG. 3 is an enlarged partial cross-sectional perspective view of the foot of the current interrupter of FIG. 2.

With reference to FIG. 3, the connection of the vacuum bottle housing 12 with foot 20 is schematically illustrated. An upper end 26 of the foot 20 can have a disc-shaped construction with holes 28 positioned at regular intervals about a circumference of the disc-shaped upper end 26. The upper end 26 can further include a circumferential groove 30 sized to receive an O-ring or other ring-shaped seal 32. In order to provide a sealed interface between the vacuum bottle housing 12 and the foot 20, a first end 34 of the vacuum bottle housing 12 can be received in a cylindrical recess defined by upright inner and outer walls 36 and 38 and lower end face 40 of a collar 42. An exterior surface of the lower end face 40 contacts seal 32 to form an interface with the upper end 26 of the foot 20. In some embodiments, the interface between the collar 42 and the foot 20 can provide a fluid-tight seal to maintain a pressurized atmosphere within the bottle and prevent water, other fluids, gasses and contaminants in general from penetrating the interior 14 of the vacuum bottle housing 12.

As shown in FIGS. 1-3, a number of ribs 44 can be positioned in spaced relation along an axial direction of an exterior surface of the outer wall 38 of the collar 42. Threaded passages 46 can be formed in ribs 44 and aligned with holes 24 in upper end 26 to receive fasteners such as threaded bolts 48 in order to couple collar 42 to foot 20. Alternatively, or additionally, bolts, rivets, adhesives or other suitable fasteners or joining techniques such as welding or soldering can be used. In other embodiments, collar 42 and foot 20 can be formed as a unitary cast structure.

Figure 4:
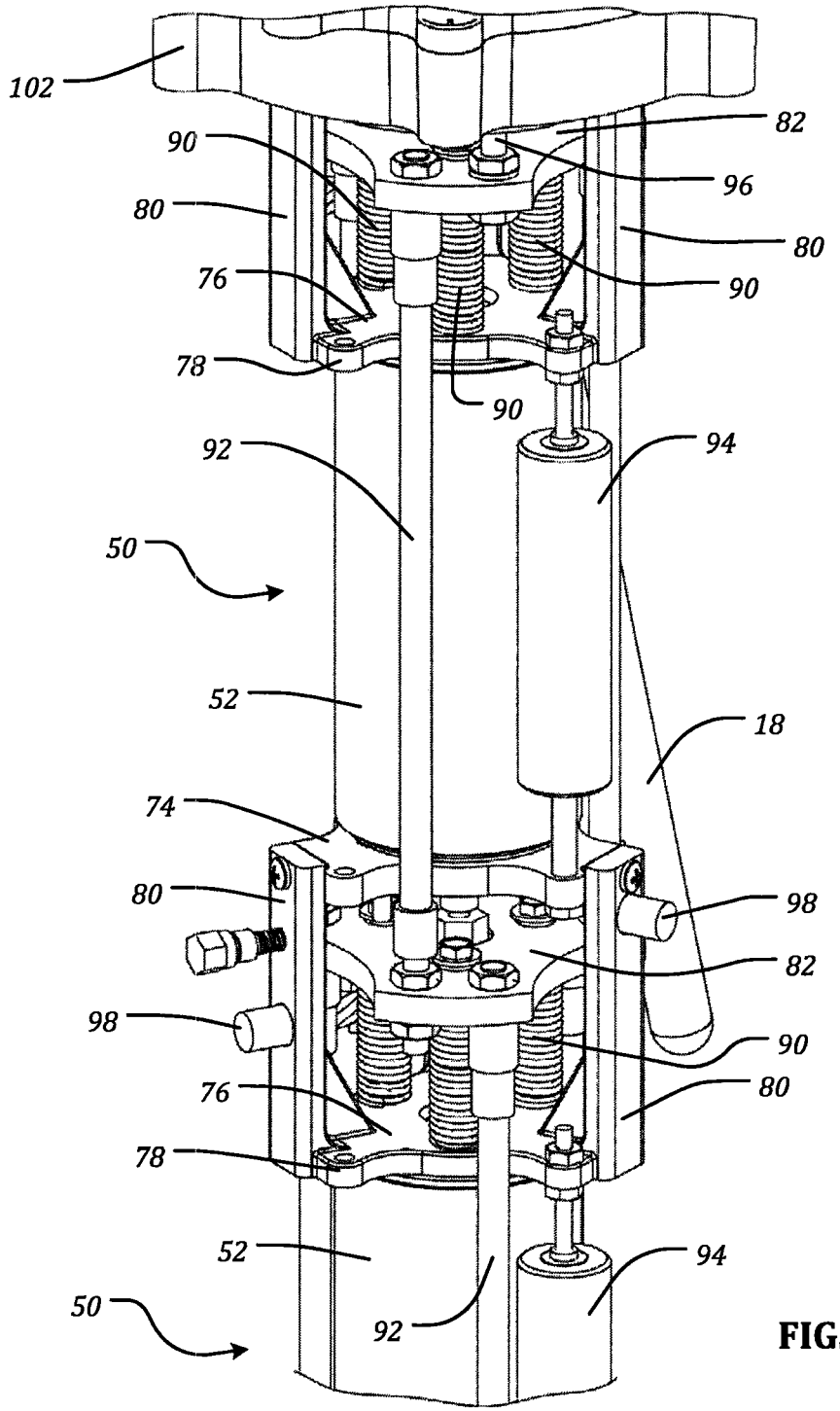
FIG. 4 is an enlarged partial perspective view of a vacuum bottle assembly of the current interrupter of FIG. 1 with the vacuum bottle housing removed.

Turning to FIG. 4, an enlarged view of vacuum bottles 50 is shown with the vacuum bottle housing 12 removed. Each vacuum bottle 50 can comprise a hollow cylindrical structure capable of maintaining a vacuum seal. As shown in FIGS. 4-10, an outer shell 52 of the vacuum bottle 50 can have a cylindrically shaped side wall 54 coupled to opposed upper and lower end faces 56 and 58. Within the outer shell 52, the lower fixed contact 60 and upper moveable contact 62 can be positioned coaxially on a central axis of the outer shell 52. Each of the fixed and moveable contacts 60 and 62 can include facing contact plates 64, 66 disposed on ends of rods 68, 70, respectively. The moveable contact 62 is slidably displaceable with rod 70 extending through a bushing 72 positioned centrally in the upper end face 56 of the outer shell 52. In some embodiments, the moveable contact 62 is displaceable with a bellows type seal that is operative to maintain a vacuum within the vacuum bottle and a positive pressure outside of the vacuum bottle 50 but within the interior 14 of the vacuum bottle housing 12. However, any suitable mechanism can be used to maintain a vacuum seal within a vacuum bottle 50.

For vacuum interrupters 10 with two or more vacuum bottles 50 as in the illustrated embodiment, one or more of the vacuum bottles 50 can be provided with lower and upper mounting plates 74 and 76, respectively, including three equiangularly spaced arms 78. The lower mounting plate 74 can be positioned adjacent to the lower end face 58 of a first vacuum bottle 50 and an upper mounting plate 76 can be positioned adjacent to the upper end face 56 of an adjacent (lower) vacuum bottle 50. In order to mount the adjacent vacuum bottles 50 to one another, the outer extremities 78 of the lower and upper mounting plates 74, 76 can be connected by upright posts 80.

For each vacuum bottle 50, rod 70 of moveable contact 62 can pass through an upper mounting plate 76 to couple to a spring biased pedestal plate 82 positioned above upper mounting plate 76. Rod 70 can couple to the pedestal plate 82 with a nut 84 on its upper end with an enlarged head forming a shoulder above the upper surface of the pedestal plate 81. In one aspect, when the pedestal plate 82 is moved upwardly and engages the thumb nut shoulder, it can raise the moveable contact 62. A cushion spring 86 surrounding rod 70 can be positioned between the bottom of pedestal plate 82 a washer 88 mounting a conductive braid 89. In one aspect, when the pedestal plate 82 is lowered, the cushion spring can be compressed between the pedestal plate 82 and the washer 88 and push the moveable contact 62 downwardly into contact with the fixed contact 60, thereby ensuring conductive engagement. Pedestal plate 82 can be biased away from upper mounting plate 76 by symmetrically and triangularly arranged return springs 90, which can, in turn, bias moveable contact 62 upwardly and away from fixed contact 60.

In embodiments including two or more serially connected vacuum bottles 50, each pedestal plate 82 can be connected with vertical rigid members 92 of a dielectric or insulating material such as fiberglass. The rigid members 92 can move each of the pedestal plates 82, and therefore, the moveable contacts 62 in a concurrent manner to achieve serial operation of the connected vacuum bottles. In other embodiments, lower and upper mounting plates 74, 76 can be connected with a capacitor 94 to provide a voltage grading effect across each vacuum bottle 50. In one aspect, the capacitor 94 can be selected to correspond to the voltage of the circuit to be interrupted.

Figure 6:
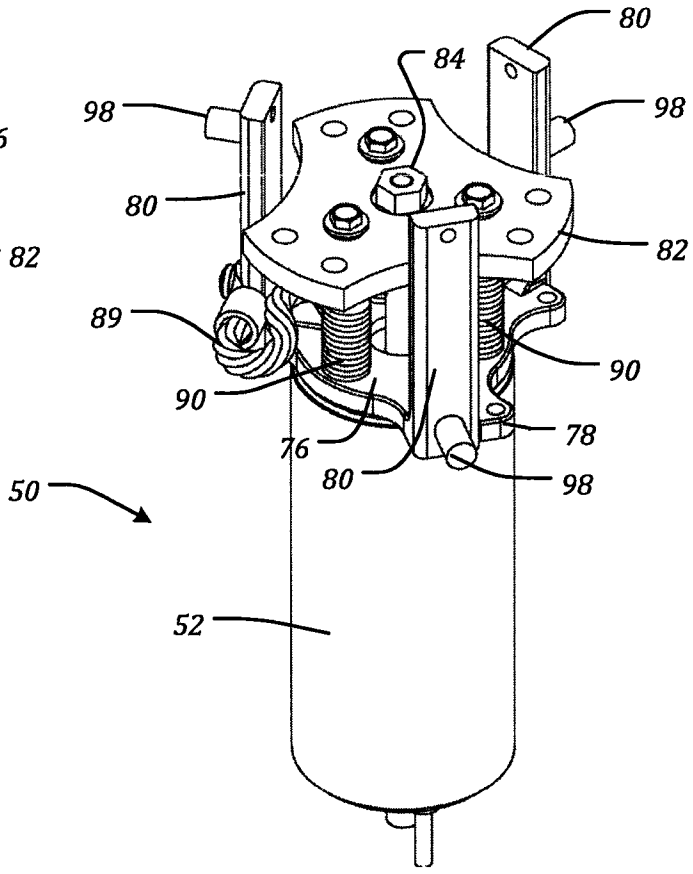
FIG. 6 is a perspective view of an intermediate vacuum bottle of the vacuum bottle assembly of FIG. 4 in isolation.
Figure 5:
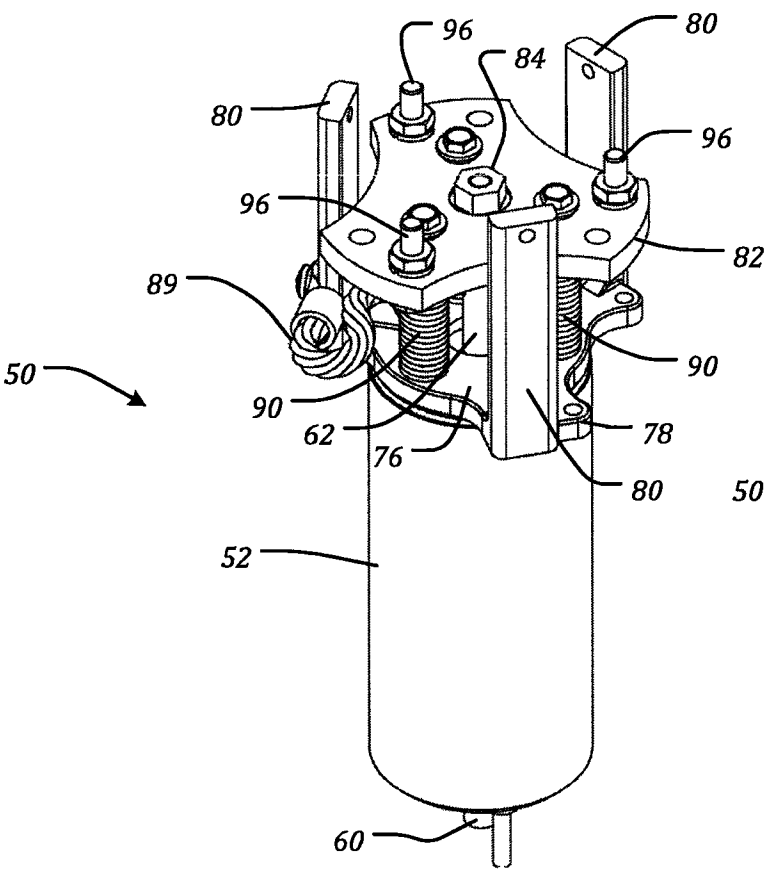
FIG. 5 is a perspective view of a topmost vacuum bottle of the vacuum bottle assembly of FIG. 4 in isolation.
Figure 7:
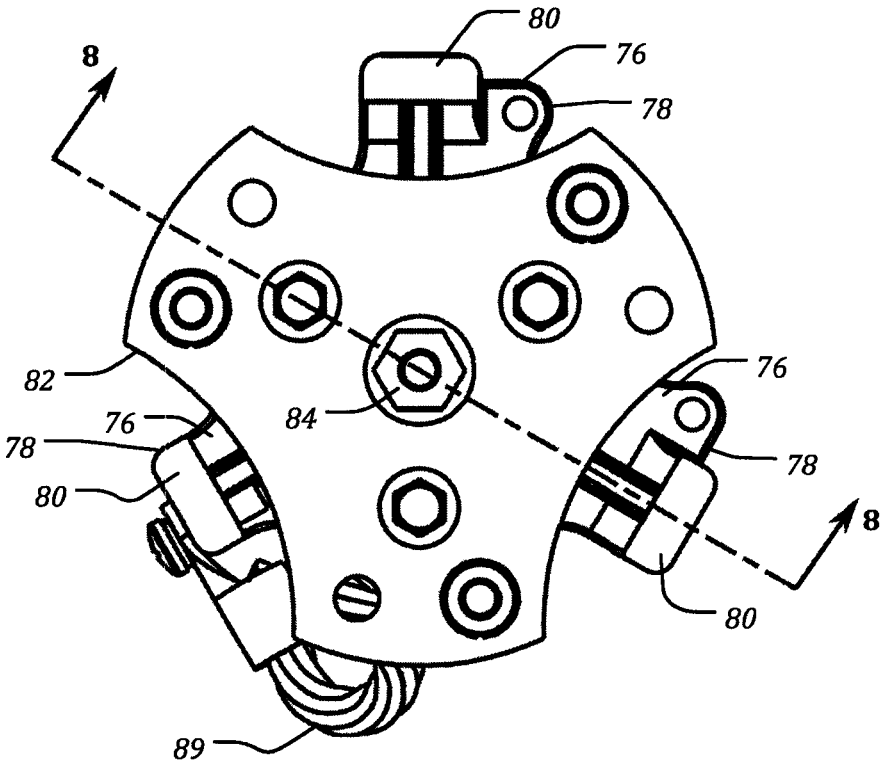
FIG. 7 is top plan view of the vacuum bottle of FIG. 5.

With respect to FIG. 5 an uppermost vacuum bottle 50 can include one or more stops 96 positioned on top of pedestal plate 82. In one aspect, the stops 96, which can be aluminum, can be used to space the pedestal plate 82 away from a seal or interface between the vacuum bottle housing 12 and the operating mechanism housing 15. Turning to FIG. 6, vacuum bottles 50 can also include studs 98 that project radially outward from posts 78. Studs 98 can abut or couple to the vacuum bottle housing 12, for example, to eliminate movement of the vacuum bottles and maintain their adjustment during shipping and installation of the device. In one aspect, studs 98 can comprise rubber or another insulating material.

Figure 11:
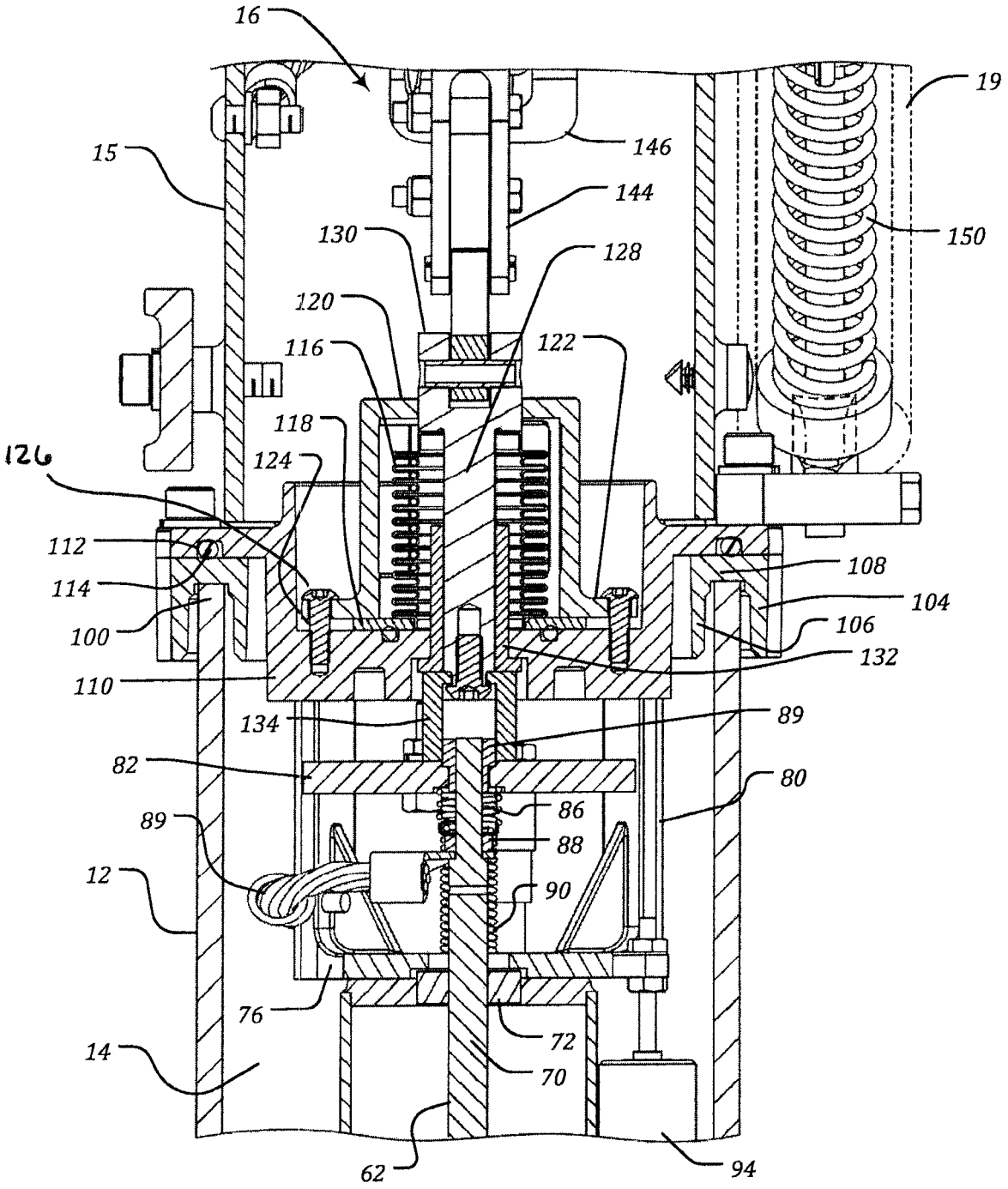
FIG. 11 is an enlarged partial cross-sectional view of the seal between the vacuum bottle housing and the operating mechanism housing of the current interrupter of FIG. 1.

As with the first end 34 of the vacuum bottle housing 12, a second end 100 of the vacuum bottle housing 12 can be received in an upper collar 102 as shown in FIG. 11. The upper collar 102 can include a cylindrical recess defined by upright inner and outer walls 104 and 106 and upper end face 108. The upper end face forms a sealed interface with a bi-stable plate 110 positioned generally between the vacuum bottle housing 12 and the operating mechanism housing 15. The bi-stable plate 110 can serve to seal the end of the vacuum bottle housing, and support the bi-stable operating mechanism 16. In one aspect, a channel 112 in the bi-stable plate 110 can accommodate an O-ring 114 to provide a sealed interface. However, as described previously, other methods for providing a seal can be used.

In addition (or alternatively), the bi-stable plate 110 can form a sealed interface with a bellows 116 disposed on the upper face of the bi-stable plate 110. The bellows 116 can comprise a conventional cylindrical steel accordion-like structure, which maintains its integrity while shortening and lengthening. In particular, bellows 116 can have a cylindrical construction with a circumferentially ribbed side wall having a serpentine cross-section as shown in FIG. 11. The ribbed side-wall can enable the bellows 116 to be alternately compressed and expanded by operation of the bi-stable operating mechanism 16 while maintaining the integrity of the seal. One method sealing the bellows with the bi-stable plate 110 can include mounting a circular gasket 118 at a base of the bellows 116. The circular gasket 118 is generally ring-shaped with an inner diameter sized to receive and seal with the lower end of the bellows 116. The gasket 118 extends radially outward from the lower end of the bellows 116 with an outer diameter of the gasket 118 being greater than an outer diameter of the bellows 116. In turn, a cylindrical bellows housing 120 can be fitted over the bellows 116 such that an externally flanged lower end 122 of the bellows housing 120 contacts a periphery of the gasket 118. An outer edge of the flanged lower end 122 can overlap and extend outward from the periphery of the gasket 118. In some embodiments, circumferentially spaced holes 124 can be provided in the flanged lower end 122. Fasteners 126 such as screws can pass through holes 124 into the upper face of the bi-stable plate 110 to mount the bellows 116 to the bi-stable plate 110.

A clevis 128 extends axially through the center of bellows 116 with a head 130 of the clevis 128 forming a seal with the upper end of the bellows 116. In one aspect, the head 130 can be welded to the bellows 116 to further provide a seal between the vacuum bottle housing 12 and the operating mechanism housing 15. The clevis 128 can pass through the bellows 116 and through a bushing 132 with an externally flanged lower end supported in a recess of on the lower end of the bi-stable plate 110. The lower end of the clevis can be coupled to a cylindrical member 134, which can contact the upper face of the pedestal plate 82 of the topmost vacuum bottle 50. The cylindrical member 134 surrounds the nut 84 connected to rod 70 of the moveable contact 62 of the topmost vacuum bottle 50. As a result, a linear, downward displacement of the clevis 128 and the cylindrical member results in the opening and the closing of the fixed and moveable contacts 60, 62.

Figure 12:
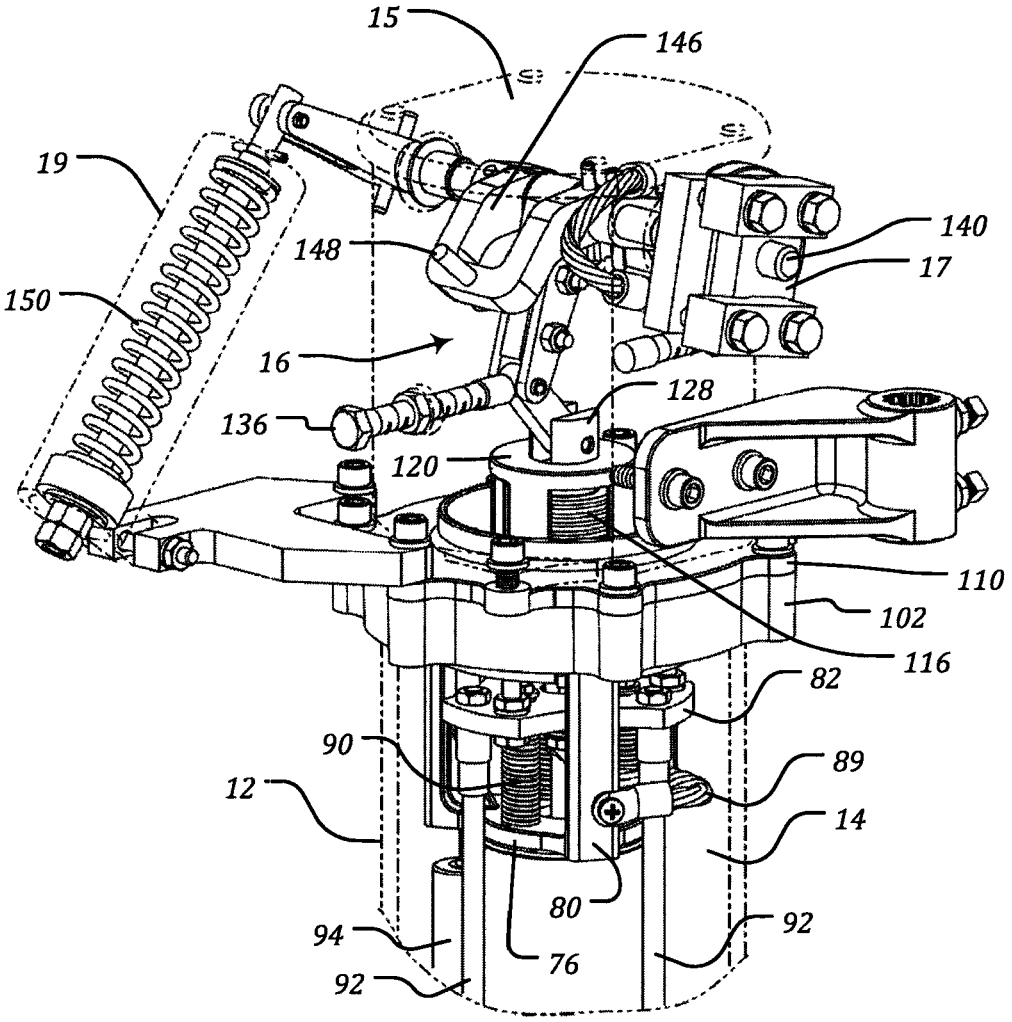
FIG. 12 is an enlarged partial perspective view of the current interrupter of FIG. 1 showing the bi-stable operating mechanism.
Figure 13:
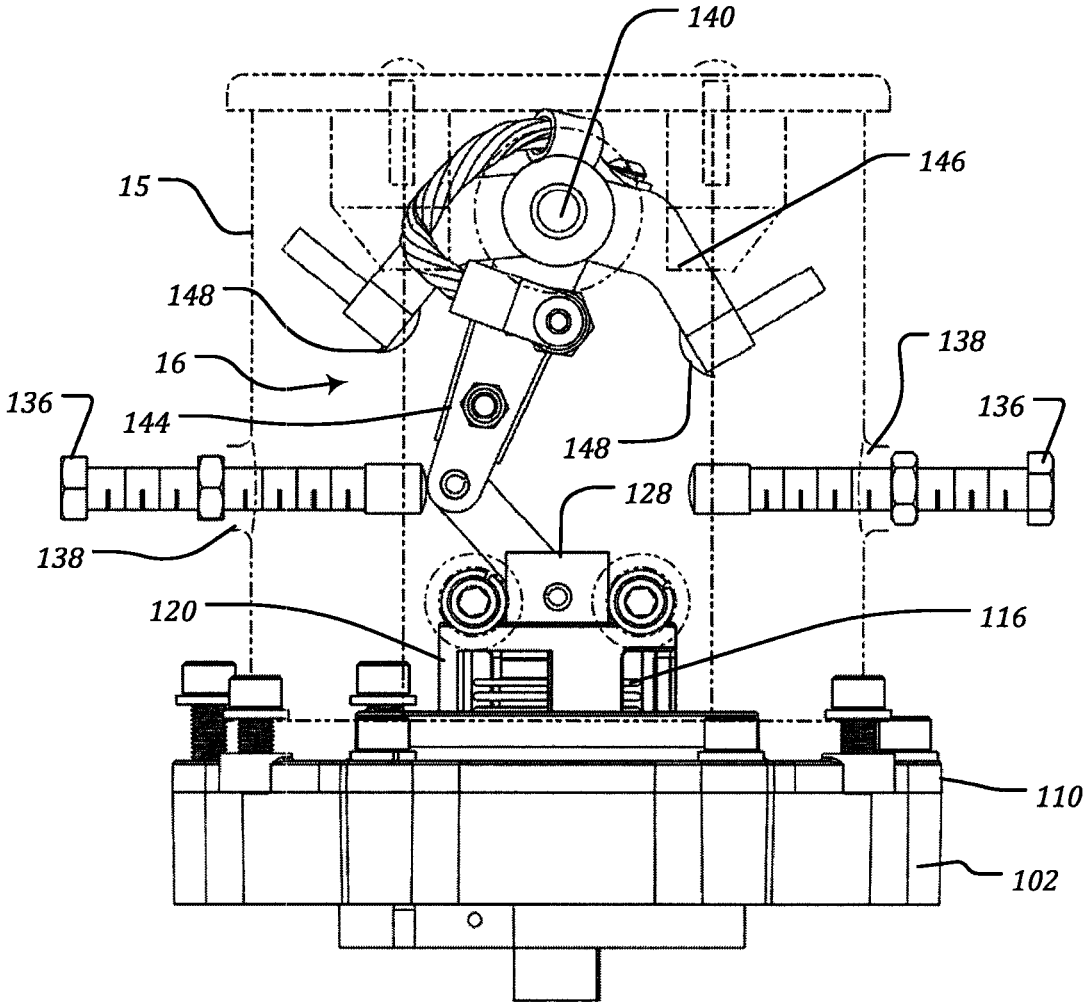
FIG. 13 is a side view of the bi-stable operating mechanism of the current interrupter of FIG. 1 in isolation.

Turning to FIGS. 12 and 13, an embodiment of a bi-stable operating mechanism 16 is shown. A pair of opposed bi-stable link adjustment bolts 136 pass through openings 138 in the operating mechanism housing 15. The bi-stable link adjustment bolts 136 are oriented in a transverse direction (i.e., orthogonal) relative to the central axis of the vacuum interrupter 10. A pin 140 extends through the operating mechanism housing 15 at a right angle relative to the opposed bi-stable link adjustment bolts 136. The pin 140 is spaced laterally apart from bi-stable link adjustment bolts 136 towards an upper end of the operating mechanism housing 15. An end of the pin 140 passes through a connector 142 of the actuator 17 located external to the cylindrical housing 64. The connector 142 is configured to receive and fasted to one end of the control arm 18 such that the control arm 18 is rotatable about an axis of the pin 140. In the example embodiment shown in FIGS. 12 and 13, the connector 142 includes a pair of clamps for retaining the operating arm 18.

The head 130 of the clevis 128 couples the moveable contact 62 of the topmost vacuum bottle 50 to bi-stable operating mechanism 16. The bi-stable mechanism 16 generally inhabits a vertical plane parallel to an axis of the vacuum interrupter 10 and comprises a pair of pivotally connected links 144 and a toggle 146. The links 144 are independently pivotable about an axis of the pin 140, while the toggle 146 is pivotable with the pin 140. A pair of bumpers 148 is coupled to the toggle 146 such that rotation of the toggle 146 causes the bumpers 148 to impinge upon the links 144 in order to displace the links 144. The extent to which the links 144 can move is limited by adjustment of the opposed bi-stable link adjustment bolts 136 which are also generally oriented in the plane of the bi-stable operating mechanism 16. Displacement of the links 144 results in a displacement of the clevis 128 along the axis of the vacuum interrupter 10, and therefore a displacement of the moveable contact 62 of the topmost vacuum bottle 50.

In one example method of operation, the vacuum interrupter 10 starts in a closed position. In the closed position, the bi-stable operating mechanism 16 is in a first position such that the moveable contacts 62 and fixed contacts 60 are made to touch. In this position the cushion spring 86 and return springs 90 are compressed by the pedestal plate 82. The pedestal plate 82 position is held by the links 144 pushing the clevis 128 against the cylindrical member 134 on the upper face of the pedestal plate 82. Contact pressure is applied to the bellows 116 and clevis 128 by the cushion spring 86 to maintain contact.

In the closed position, a current can travels through the vacuum interrupter 10, in the following manner. Current travels through the foot 20, to collar 42 and into the fixed contact 60 of the lowermost vacuum bottle 50. The current then flows from the fixed contact 60 to the moveable contact 62 and into one of the upright posts 80 through conductive braid 89 to the lower mounting plate 74 of the next adjacent vacuum bottle 50. The current can flow from the lower mounting plate 74 to the fixed contact 60 of the respective vacuum bottle 50 and so forth through each of the connected vacuum bottles 50. From the conductive braid 89 of the topmost vacuum bottle 50, the current can travel through the pin 140 via a second flexible conductive braid, and into the conductive control arm 18.

The vacuum interrupter 10 provides arc quenching when transitioned into the open position. Opening occurs when the control arm 18 is pivoted on the axis of the pin 140, thereby rotating the toggle 146 and bumpers 148. As the bi-stable links 144 are forced over center by the bumpers 148, the clevis 128 releases the pedestal plate 82 allowing the return springs 90 to push upward. The pedestal plate 82 pushes the nut 84, which is coupled to the clevis 128 and bellows 116, upward. This action pulls the moveable contacts 62 upward to the open position.

Figure 8:
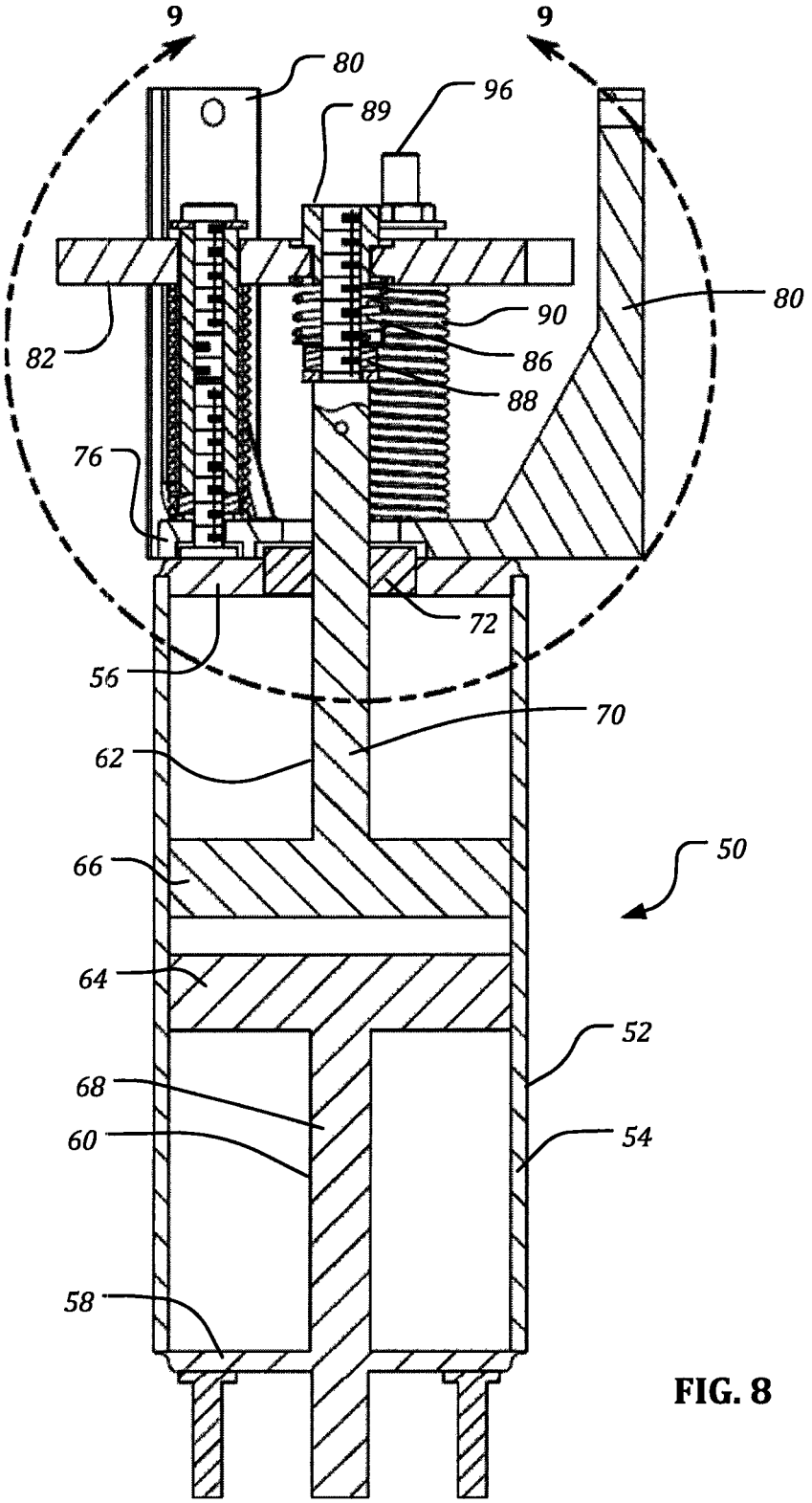
FIG. 8 is a cross-sectional view of the vacuum bottle of FIG. 4 as taken along line 8-8 of FIG. 7.
Figure 9:
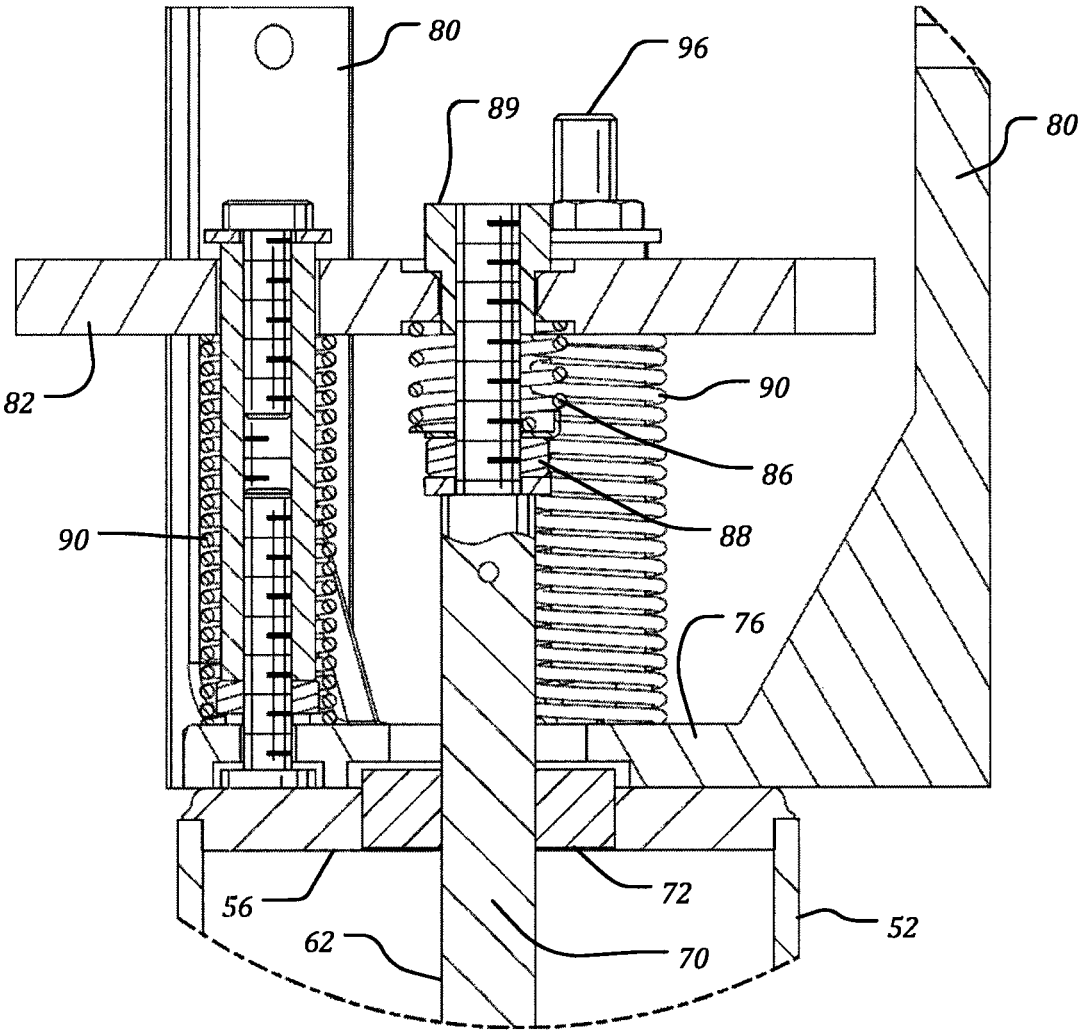
FIG. 9 is an enlarged partial cross-sectional view of the vacuum bottle of FIG. 5 as taken along arc 9-9 of FIG. 8.
Figure 10:
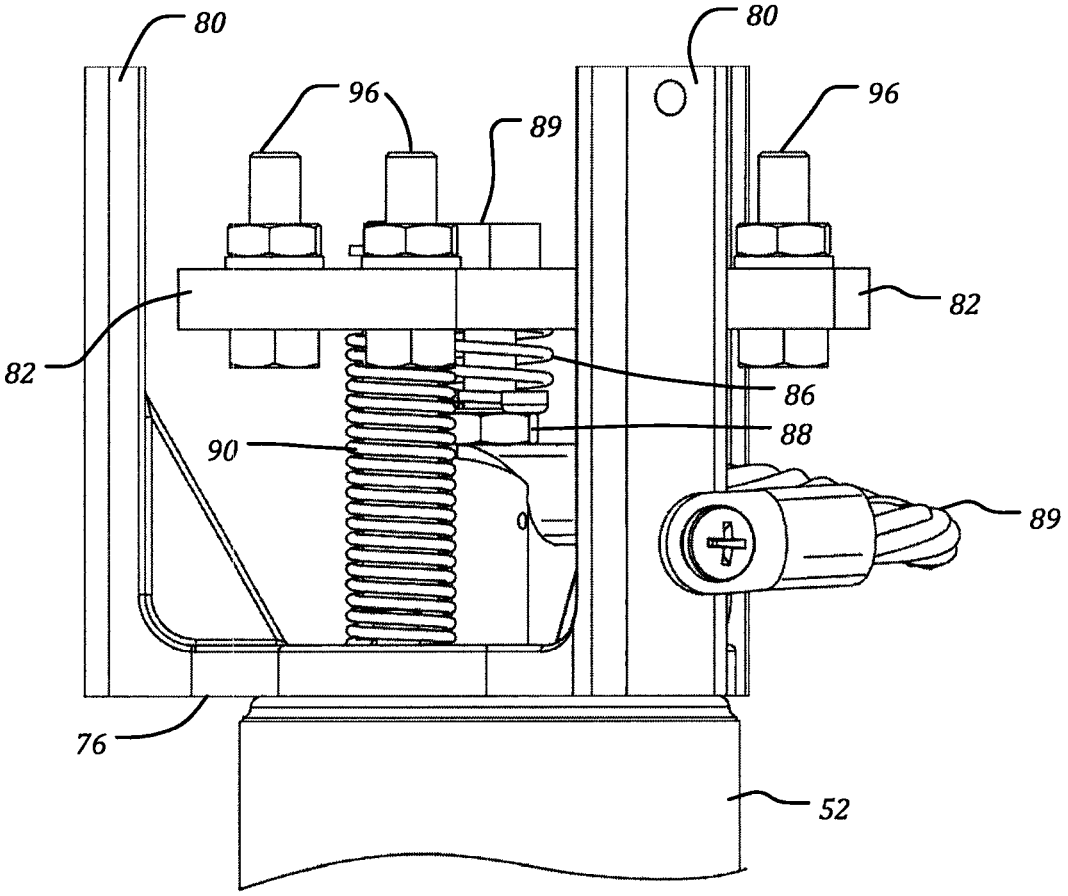
FIG. 10 is an enlarged partial side view of vacuum bottle of FIG. 5.

As shown at least in FIG. 8, the difference in the two positions of the bi-stable operating mechanism 16 is a ¼ inch displacement along the central axis of the vacuum interrupter 10. Within the reset mechanism 19, a compression spring 150 biases the bi-stable operating mechanism 16 towards a closed position of the vacuum interrupter 10. The bi-stable operating mechanism 16 can be used as it provides for free and rapid movement of the pedestal plates and the vacuum bottle contacts, as is required for quick separation of the contacts.

The present vacuum interrupter assembly improves upon prior art vacuum interrupter by providing a seal between the vacuum bottle housing and the operating mechanism housing. In one aspect, the bi-stable operating mechanism can require both rotational and linear movements. For example, the control arm is rotatable to displace the bi-stable links from a first position to a second position. In turn, the bi-stable links can effect a linear displacement of the clevis and the moveable contacts. By providing the seal between the vacuum bottle housing and the operating mechanism housing, it can be only necessary to provide a seal for a linear movement and not also a rotational movement. In one aspect, a bellows can provide an expandable seal to enable to the linear movement. However, other seals can be used in place of a bellows to accommodate a sealed, linear displacement.

According to another aspect of the present disclosure, a vacuum interrupter includes a pressurized vacuum bottle housing. However, it is possible that the current interrupter of this disclosure can include a plurality of vacuum bottles contained in various housings. For example, the vacuum bottles may be housed in pressurized fiberglass tubes, or a solid insulating material such as an epoxy or resin, and in particular, a cycloaliphatic epoxy.

For example, the general orientation of the vacuum interrupter, and components thereof, can differ from that depicted in the figures. In particular, the figures illustrate a generally vertically extending vacuum interrupter. However, the vacuum interrupter can instead be at an arbitrary angle to the horizon. Therefore, any words of orientation, such as various forms of "up", "down", "top", "bottom," "above," and "below", used herein are for the purpose of describing particular embodiments only and are not intended to be limiting of the disclosure.

While there has been shown and described what are at present considered the preferred embodiment of the invention, it will be obvious to those skilled in the art that various changes and modifications can be made therein without departing from the scope of the invention.

What is claimed is:

1. A vacuum interrupter for interrupting a voltage comprising:

a vacuum bottle housing having an interior and an exterior;

at least one vacuum bottle positioned within the interior of the vacuum bottle housing, the at least one vacuum bottle including axially separable contacts within it, at least one of which is a moveable contact;

an operating mechanism coupled to the moveable contact, the operating mechanism including a clevis configured to reciprocate the movable contact;

a seal between the vacuum bottle housing and the operating mechanism sealing the operating mechanism from the interior of the vacuum bottle, wherein the seal includes a first end and a second end, the first end coupled to the clevis and the second end coupled to the vacuum bottle housing;

a gasket positioned between the seal and the vacuum bottle housing, the gasket having an inner diameter configured to receive the second end of the seal and extend radially outward from second end of the seal; and a seal housing enclosing the seal, the seal housing including an externally flanged lower end contacting the gasket.

2. The vacuum interrupter of claim 1, wherein the seal comprises a bellows.

3. The vacuum interrupter of claim 1, wherein a second vacuum bottle is serially connected with the at least one vacuum bottle, the second vacuum bottle positioned within the interior of the vacuum bottle housing.

4. The vacuum interrupter of claim 3, wherein the the second vacuum bottle includes a second moveable contact and the moveable contacts are coupled to a spring-biased pedestal plate.

5. The vacuum interrupter of claim 4, wherein the spring-biased pedestal plates are connected with a rigid member.

6. The vacuum interrupter of claim 5, wherein the rigid member comprises a dielectric material.

7. The vacuum interrupter of claim 1, wherein the vacuum bottle housing is pressurized.

8. The vacuum interrupter of claim 1, wherein the vacuum bottle housing comprises a solid housing.

9. The vacuum interrupter of claim 8, wherein the solid housing comprises a polymer epoxy.

10. The vacuum interrupter of claim 9, wherein the polymer epoxy is a cycloaliphatic polymer epoxy.

11. A vacuum interrupter for interrupting a voltage comprising:

a vacuum bottle housing having an exterior and an interior, the vacuum bottle housing generally defining a fiberglass tube;

at least one vacuum bottle positioned within the interior of the vacuum bottle housing, the at least one vacuum bottle including axially separable contacts within it, the axially separable contact comprising a fixed contact and a moveable contact;

an operating mechanism coupled to the moveable contact, the operating mechanism including a clevis configured to reciprocate the moveable contact;

a bellows seal between the vacuum bottle housing and the operating mechanism sealing the operating mechanism from the interior of the vacuum bottle, wherein the seal includes a first end and a second end, the first end coupled to the clevis and the second end coupled to the vacuum bottle housing;

a gasket positioned between the bellows seal and the vacuum bottle housing, the gasket having an inner diameter configured to receive the second end of the bellows seal and extend radially outward from second end of the bellows seal; and a bellows seal housing enclosing the bellows seal, the bellows seal housing including an externally flanged lower end contacting the gasket.

12. The vacuum interrupter of claim 11, wherein a second vacuum bottle is serially connected with the at least one vacuum bottle, the second vacuum bottle positioned within the interior of the vacuum bottle housing.

13. The vacuum interrupter of claim 12, wherein the second vacuum bottle includes a second moveable contact and the moveable contacts are each coupled to a spring-biased pedestal plate.

14. The vacuum interrupter of claim 13, wherein the spring-biased pedestal plates are connected with a rigid member.

15. The vacuum interrupter of claim 14, wherein the rigid member comprises a dielectric material.

16. The vacuum interrupter of claim 11, wherein the vacuum bottle housing is pressurized.

17. The vacuum interrupter of claim 11, wherein the vacuum bottle housing comprises a solid housing.

18. The vacuum interrupter of claim 17, wherein the solid housing comprises a polymer epoxy.

19. The vacuum interrupter of claim 18, wherein the polymer epoxy is a cycloaliphatic polymer epoxy.

20. A vacuum interrupter for interrupting a voltage comprising:

a vacuum bottle housing having a pressurized interior and an exterior;

at least one vacuum bottle positioned within the interior of the vacuum bottle housing, the at least one vacuum bottle including axially separable contacts within it, at least one of which is a moveable contact;

an operating mechanism, the operating mechanism including a clevis configured to reciprocate the moveable contact;

a seal between the vacuum bottle housing and the operating mechanism sealing the operating mechanism from the interior of the vacuum bottle, wherein the seal includes a first end and a second end, the first end coupled to the clevis and the second end coupled to the vacuum bottle housing;

a gasket positioned between the seal and the vacuum bottle housing, the gasket having an inner diameter configured to receive the second end of the seal and extend radially outward from second end of the seal; and a seal housing enclosing the seal, the seal housing including an externally flanged lower end contacting the gasket.

* * * * *